United States Patent [19]

Dimitrov

[11] Patent Number: 4,495,757

[45] Date of Patent: Jan. 29, 1985

[54] METHOD OF AND APPARATUS FOR MANUFACTURING YARN WITH A CORE

[75] Inventor: Milko D. Dimitrov, Sofia, Bulgaria

[73] Assignee: N P S P "Novotex", Sofia, Bulgaria

[21] Appl. No.: 466,647

[22] Filed: Feb. 15, 1983

[30] Foreign Application Priority Data

Feb. 15, 1982 [BG] Bulgaria ..... 55375

[51] Int. Cl.[3] ..... D02G 3/36; D02G 3/34

[52] U.S. Cl. ..... 57/5; 57/6; 57/224; 57/328; 57/350

[58] Field of Search ..... 57/3, 5, 6, 11, 210, 57/224–228, 315, 328, 331, 908

[56] References Cited

U.S. PATENT DOCUMENTS

| | | | |
|---|---|---|---|
| 800,013 | 9/1905 | Phillips et al. | 57/5 |
| 3,822,543 | 7/1974 | Edagawa et al. | 57/5 |
| 4,028,871 | 6/1977 | Aschenbrenner | 57/5 X |
| 4,056,924 | 11/1977 | Umiastowski | 57/331 X |

*Primary Examiner*—Donald Watkins

[57] ABSTRACT

Method of and apparatus for making yarn with a core, wherein the free fibers are tightly attached to the core and are wound around it. The core of fibrous material is fed by a pair of feeding rollers, the core being fed through a first jet for the formation of wrapping of fibers. In the first jet, fibers are laterally driven in by an air stream. Simultaneously with the laterally led in fibers in the first jet for the formation of wrapping, there is driven in an additional core thread, which moves with the linear velocity of the core. Such additional core thread is made of fibrous material of staple fibers or is made of filament material. The laterally led in fibers and the additional core thread have a mutual trajectory of movement and are driven in the jet for the formation of wrapping by the suction of the tangentially fed same jet air stream. The composite thread formed from the core of the said fibrous material, the additional core thread, and the laterally fed fibers are false twisted by a tangentially led in air stream in a subsequent, second false twisting jet. The pressure of the air stream for the false twisting of the core from fibrous material, with the additional core thread and the laterally fed fibers, is at least equal to the pressure of the tangential air stream for leading in the fibers in the jet for the formation of wrapping.

14 Claims, 3 Drawing Figures

METHOD OF AND APPARATUS FOR MANUFACTURING YARN WITH A CORE

This invention relates to a method of and an apparatus for manufacturing a yarn with a core, such yarn being useful in the textile industry.

U.S. Pat. No. 4,056,924 to Umiastowski discloses a method for manufacturing yarn with a core. In accordance with such patent a bundle of fibers is drawn as in conventional spinning and then upon the drawn fibrous bundle free staple fibers are placed approximately at a right angle. Such free staple fibers are attached to the surface of the fibrous bundle. The thus obtained composite structure of fibers is fed under a suitable control tension through the interior of a rotating hollow cylindrical element which imparts twist to the composite fibrous structure, such structure is then afterwards wound in the form of a cross bobbin.

Apparatus for carrying out such method comprises a device for drawing the fibrous sliver and immediately next to it in the direction of the axis of the drawn bundle of fibers there are placed one after the other a device for the opening of the fibers and a cylindrical element rotating at high speed. The upper part of the inlet opening of the hollow cylindrical element has a grooved surface, so that the protecting ends of fibers which are loosely attached to the drawn fibrous bundle can be arrested to that surface by twisting or winding in a screw mode around the core, respectively or around the drawn bundle of fibers.

A disadvantage of the known method and apparatus is that most of the fibers do not tightly envelop the core, and do not twist; this is why the obtained wrapping of fibers is unstable and deteriorates the structure of the yarn.

A further method is described in Melliand-Textilberichte 6/1979, pages 452–456 for manufacturing yarn with a core by wrapping the core with fibers. This is the so-called method for pneumatic spinning by wrapping, according to which the drawn roving for forming the core is axially fed through an air jet meant for the formation of wrapping. Inside that jet laterally at an angle there are fed fibers for the formation of the wrapping, which fibers are formed of drawn roving. The free fibers are directed toward the core, passing through the jet for the formation of wrapping by the flow of air. At the moment of superimposing the fibers upon the core there is applied a false twisting to the yarn.

The apparatus which carries out such method comprises a device for high draft, followed by a jet which is axially placed in the direction of the core, the jet being adapted for the forming of wrapping and a jet for false twisting. The device comprises a pulling-out pair of rollers, which feed the newly formed composite yarn to a winding roller for the formation of a cross bobbin.

A disadvantage of the last described prior method and apparatus is that in the jet for the formation of the wrapping, only a small number of fibers are in a vorticular movement, entangling with the core. In that bundle of fibers most often there are oriented parallel to the core or just partially twisted around it, as a result of which the nipping between the fibers and the core, before the jet for false twisting, is negligible. For that reason, the air in this jet provokes a displacement of the fibers of the wrapping towards, that is, in relation to, the core and deteriorates the structure of the yarn. Thus along the length of the finished composite yarn there are sections wherein the fibers are missing in the cases in which a thread is used for the core. It is also established that for twists with a smaller number than 400 in one meter it is impossible to spin yarn by this method.

The present invention has among its objects the creation of a method of and an apparatus for making a yarn with a core, wherein the free fibers are tightly attached to the core and are wound around it.

The above object is attained by a method in accordance with the invention, according to which the core of fibrous material is fed by a pair of feeding rollers, the core being fed through a first jet for the formation of wrapping of fibers. In such first jet, fibers are laterally driven in by air stream. In the jet for false twisting, simultaneously with the laterally led in fibers in the jet for the formation of wrapping, there is driven in an additional core thread, which moves with the linear velocity of the core, such additional core thread is made of fibrous material of staple fibers or is made of filament material. The laterally led in fibers and the additional core thread have a mutual trajectory of movement and are driven in the jet for the formation of wrapping by the suction of the tangentially fed same jet air stream. The composite thread formed from the core of the said fibrous material, the additional core thread, and the laterally fed fibers are false twisted by a tangentially led in air stream in a second, subsequent false twisting jet. The pressure of the air stream for false twisting of the core from fibrous material, with the additional core thread and the laterally fed fibers, is at least equal to the pressure of the tangential air stream for leading in the fibers in the jet for the formation of wrapping. For the core of said fibrous material there can be used a drafted bundle of fibers, controllably fed filament as well, a thread from twisted staple fibers, or any combination of the said fibrous material, which can be fed with equal or different linear velocities in the very combination as an additional core thread, driven along with the fibers in the jet for the formation of wrapping; also, a filament and/or a thread made from twisted staple fibers can be used.

The velocity of the laterally led in fibers, and that of the core made from a drawn bundle of fibers is at least equal to the velocity of the composite thread.

The apparatus for practicing the above method comprises a pair of feeding rollers, a jet for the formation of wrapping, such jet being supplied with a lateral tube for driving in fibers by an air stream or current, a jet for false twisting, and a pair of pulling out rollers. The said pair of rollers and jets are placed consecutively one after the other along the mutual tangent of the feeding pair of rollers and the pulling pair of rollers. Into the jet for the formation of wrapping there is formed a tangential opening to which there is fixedly mounted a tube, the tube being connected with the pneumatic system, such system being supplied with a deviated tube for feeding the laterally led in fibers and the additional core thread.

In the jet for false twisting there is also formed a tangential opening in which there is fixedly mounted a tube for connection with the pneumatic system. The axes of the tubes fixed to the tangential openings, in accordance with the jet for the formation of wrapping and the jet for false twisting, are located crosswise at right angles to the axes of the said jets.

The jet for the formation of wrapping has an inner diameter greater than the inner diameter of the jet for false twisting.

The outgoing opening of the jet for the formation of wrapping is greater than the inlet opening. Reversely, the jet for false twisting has an inlet opening greater than the outgoing opening.

The advantage of the invention is that a yarn with a stable structure is produced, such yarn being useful for the production of knitted and woven goods. The method of and apparatus for manufacturing yarn with a core in accordance with the invention provide the possibility of processing almost all types or combinations of materials, so that the yarn can receive all desired properties, which is a result not only of the method itself, but as well of the materials or combinations of materials used for fibers or filaments.

A detailed explanation of the invention is given in the enclosed drawings, wherein.

Figure 1:
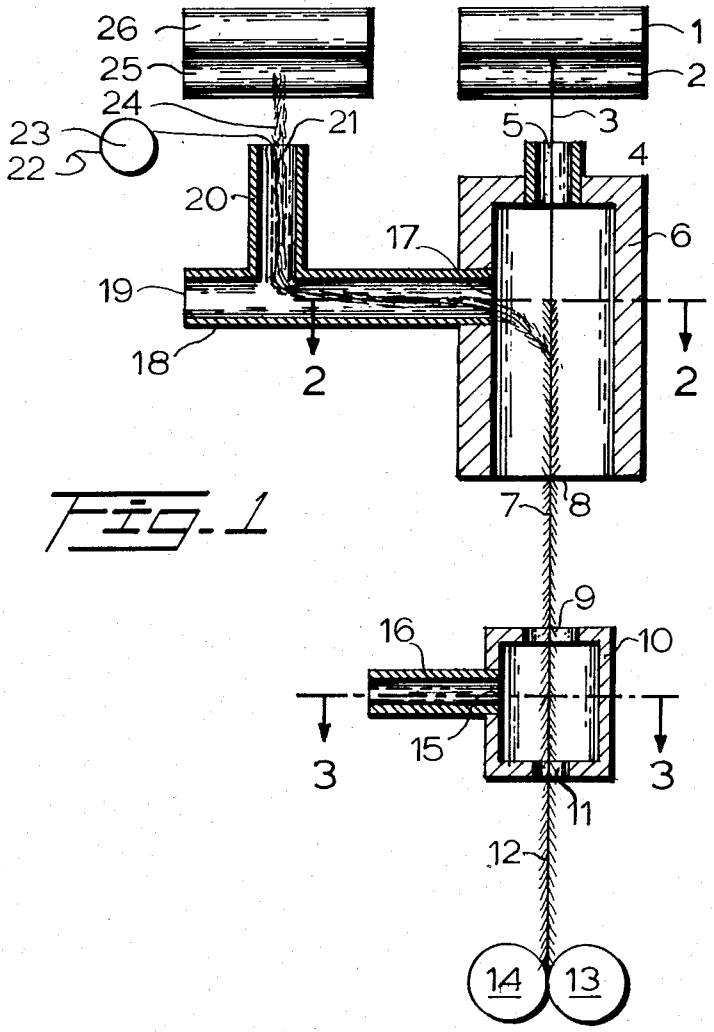
FIG. 1 is a schematic view of the embodiment of the apparatus according to the present invention.

Turning first to FIG. 1, the device comprises a feeding pair of rollers 1, 2 for feeding a core 3 made of staple fibers and/or filaments. Along the line of the mutual tangent of the feeding pair of rollers 1, 2 in the direction of feeding of the core 3, there is disposed a jet 6 for the formation of wrapping, the jet having an inlet opening 5. Upon such jet 6 at the inlet opening thereof there is coaxially fixed a tube 4. The inlet opening 5 and the outlet opening 8 of the jet 6 are coaxial. The inlet opening 5 has a smaller diameter than the outgoing opening 8.

Figure 2:
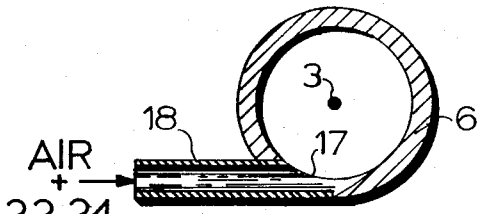
FIG. 2 is a section taken along the line 2—2 in FIG. 1 of the drawings.

As shown in FIGS. 1 and 2, the jet 6 is provided with a tube 18 affixed thereto, the tube providing an opening 17 therethrough which is disposed tangential to the main passage within the jet 6. Affixed to the tube 18, radially outwardly of the jet 6, there is a tube 20 disposed parallel to the jet 6, tube 20 feeding laterally driven in fibers 24 and an additional core thread 22 into the opening 21 at the upper end of tube 20. Above tube 20 and in line therewith there is a pair of rollers 25, 26 of a drawing apparatus (not shown). Next to the opening 21 of the tube 20 there is disposed a braking unit 23 for the additional core thread 22.

Figure 3:
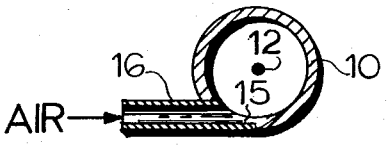
FIG. 3 is a section taken along the line 3—3 in FIG. 1 of the drawings.

Under the jet 6 for the formation of wrapping in the direction of travel of the core 3 there is disposed a jet 10 for false twisting. Jet 10 has an inlet opening 9 and an outlet opening 11 which are formed one after the other along the axis of the jet. The jet 10 for false twisting has a tangential opening 15 (FIG. 3) to which there is fixedly attached a tube 16 adapted to receive air under pressure.

The axis of the jet 6 for the formation of wrapping and the axis of the tube 18 are disposed crosswise, that is at 90 degrees with respect to each other. The axis of the jet 10 for false twisting is also disposed at 90 degrees with respect to the axis of its tube 16. Downstream of the jet 10 for false twisting there is disposed a pulling pair of rollers 13, 14.

The above-described apparatus operates as follows:

The core 3 made of fibrous material of staple fibers or filament, when made of a drawn bundle of fibers, is fed by the feeding pair of rollers 1, 2 and enters through the inlet opening 5 of the jet 6 for the formation of wrapping. The core 3 there joins the fibers 24 coming through the tangential opening 17 by the aid of air current, such fibers 24 being fed by the outgoing pair of rollers 25, 26 of a drawing apparatus (not shown). In the offset tube 20 attached to the tube 18 there is created an underpressure by the passage of supercharging air through the opening 19, and as a result the fibers 24 are sucked through the opening 21 and are transported toward the jet 6 for the formation of wrapping. Through the offset tube 20 there passes an additional core thread 22, braked by the braking unit 23, and the said additional core thread is led by the pulling pair of rollers 13, 14 with the said linear velocity as that of the formed composite yarn 7.

The composite yarn 7 passes through the inlet opening 9 of the jet 10 for false twisting, where it receives a rotating movement by the air coming in through the tangential opening 15, and leaves the jet 10 for false twisting through the outgoing opening 11, being led away by the pulling pair of rollers 13, 14.

The additional core thread 22 coming through the tangential opening 17 receives part of the twist of the composite thread 7, obtained by the rotation of the said thread in the jet 10 for false twisting. As a result of that, the additional core thread 22 winds around itself part of the fibers 24 coming through the tangential opening 17, and then joins and twists with the twisting core 3 made of staple fibers and/or filament, in the form of a composite thread 7. At the joining of the additional core thread 22 with the core 3, the laterally driven in fibers 24 wound around the additional core thread 22 are tightly pressed. The vortex formed in the jet 6 for the formation of wrapping by the passage of air through the tangential opening 17 twists the free ends of one part of the laterally driven in fibers 24 around the additional core thread 22, and another part of them is also partially twisted around the core 3.

The fibers 24 with a greater length can simultaneously wind around the additional core thread 22, around the core 3 and around the composite thread 7. Another part of the fibers 24 entering the jet 6 for the formation of wrapping wind around the twisting core 3. At the joining and twisting of the core 3 with the additional core thread 22, the laterally driven in fibers 24 are tightly pressed between the core 3 and the additional core thread 22. The vortex formed in the jet 6 for the formation of wrapping twist part of the already pressed fibers 24 around the core 3, and another part of them is twisted around the additional core thread 22. The laterally driven in fibers 24, which are longer, can partially twist simultaneously around the core 3, around the additional core thread 22, and around the formed composite thread 7.

Thus an entanglement is attained of the fibers 24 and a pressing of said fibers by the additional core thread 22 and the core 3, and at that position the fibers 24 are led from the composite thread 7 to the jet 10 for false twisting, where their free ends are tightly wound around the composite thread 7 and prevent the total untwisting of the core 3 and staple fibers and/or filament and the additional core thread 22 which are twisted together. Upon the untwisting of the core 3 and the additional core thread 22, the fibers are twisted more tightly about them, thus producing the final yarn 12, which is fed away by the pulling pair of rollers 13, 14.

In accordance with the method of manufacturing yarn 12, the air pressure in the jet for false twisting is usually kept greater than the pressure of air in the jet 6 for formation of the wrapping.

In the cases when the core 3 is made from a drawn bundle of fibers, the velocity of the laterally driven fibers 24 and that of the core 3 is at least equal to the velocity of the composite thread 7, respectively, the yarn 12. For additional core thread 22 there can be used filament and/or thread from twisted staple fibers.

Although the invention is illustrated and described with reference to a plurality of embodiments thereof, it is to be expressly understood that it is in no way limited to the disclosure of such preferred embodiments but is capable of numerous modifications within the scope of the appended claims.

I claim:

1. A method for manufacturing yarn with a core, comprising feeding a first core made of fibrous material by a pair of feeding rollers, passing the first core through a first jet of gas, driving fibers laterally into said first jet by a tangential gas current to form a wrapping about the first core, at the time of passing the fibers through the first gas jet for the formation of wrapping upon the first core imparting a false twisting to the composite material made up of the first core and the wrapping simultaneously with the lateral driving in of fibers by a tangential air current in the first jet leading in a second additional core thread at the linear velocity of the fibrous material for forming the wrapping core from the laterally driven in fibers, and false twisting the composite thread resulting from the confluence of the wrapping, the first core, and the additional core thread by a tangentially fed gas current in a second, subsequent, gas jet.

2. A method according to claim 1, wherein the additional core thread and the laterally driven in fibers move together along the same trajectory.

3. A method according to claim 1, wherein the pressure of the tangential gas current for the false twisting of the core from staple fibers and/or filament with the additional core thread and the laterally driven in fibers is at least equal to the pressure of the tangential gas current for driving the fibers in the jet for the formation of wrapping.

4. A method according to claim 1, wherein the core is a drawn bundle of fibers.

5. A method according to claim 1, wherein the additional core thread is a filament.

6. A method according to claim 3, wherein the velocity of the laterally fed fibers and the velocity of the core composed of a drawn bundle of fibers is at least equal to the velocity of the final, composite thread.

7. Apparatus for manufacturing yarn with a core, comprising a feeding pair of rollers, a first jet for the formation of wrapping, said first jet having a lateral tube for feeding in fibers by a gas jet, a second, false twisting, jet, and a pair of pulling out rollers, the feeding pair of rollers, the first jet, the second jet, and the pair of pulling out rollers being consecutively disposed along a mutual tangent for the feeding pair of rollers and the pulling pair of rollers, in the first jet there being formed a tangential opening to which there is affixed at right angles with respect to the axis of said jet a tube for feeding in fibers, said tube being supplied with a deviated tube spaced from the jet proper for feeding laterally driven in fibers and an additional core thread, and in the second, false twisting, jet there is formed a tangential opening in which there is affixed a tube disposed crosswise at right angles with respect to the axis of said second jet, said tube feeding air into the jet for false twisting the thread passing therethrough.

8. Apparatus according to claim 7, wherein the diameter of the outgoing opening of the first jet for the formation of wrapping is greater than the diameter of the inlet opening of said first jet.

9. Apparatus according to claim 7, wherein the inner diameter of the second, false twisting, jet is smaller than the inner diameter of the first jet for the formation of wrapping.

10. Apparatus in accordance with claim 7, wherein the diameter of the inlet opening of the second, false twisting, jet is greater than the diameter of the outgoing opening of said second jet.

11. A method according to claim 1, wherein the core is a drawn bundle of fibers and a controllably fed filament thread.

12. A method according to claim 1, wherein the core is a drawn bundle of fibers and a thread made of twisted staple fibers.

13. A method according to claim 1, wherein the additional core thread is a filament.

14. A method according to claim 1, wherein the additional core thread is a thread made from twisted staple fibers.

* * * * *